United States Patent [19]

Rubio

[11] Patent Number: 4,795,350

[45] Date of Patent: Jan. 3, 1989

[54] EDUCATIONAL TOY

[76] Inventor: Maria L. Rubio, 3902 Middle St., Lake Wales, Fla. 33853

[21] Appl. No.: 130,197

[22] Filed: Dec. 8, 1987

[51] Int. Cl.[4] ..... A63B 55/04; G09B 1/04; A45C 13/04

[52] U.S. Cl. ..... 434/159; 383/43; 150/51; 248/97; 434/205

[58] Field of Search ..... 273/272; 383/6, 9, 43, 383/119; 434/159, 167, 170, 172, 205; 248/97, 98, 175; 150/51

[56] References Cited

U.S. PATENT DOCUMENTS

| | | | |
|---|---|---|---|
| 140,722 | 7/1873 | Muldaur | 434/167 |
| 1,838,702 | 12/1931 | Partridge | 150/51 X |
| 1,864,703 | 6/1932 | West | 434/159 |
| 2,412,759 | 12/1946 | Sullivan | 434/159 |
| 3,116,927 | 1/1964 | Kuhlman | 434/172 X |
| 3,614,042 | 10/1971 | Jensen | 248/97 |
| 3,768,179 | 10/1973 | Woodford et al. | 434/159 |
| 3,811,206 | 5/1974 | Gaicetta | 434/159 |
| 3,853,321 | 12/1974 | Claffie | 434/159 |
| 4,157,801 | 6/1979 | Elmer | 248/97 |
| 4,306,868 | 12/1981 | Hankins | 434/159 |
| 4,467,989 | 8/1984 | Stroh | 248/97 |
| 4,705,246 | 11/1987 | Wolf | 248/97 |

*Primary Examiner*—Ira S. Lazarus
*Assistant Examiner*—Peggy Neils
*Attorney, Agent, or Firm*—Jerry T. Kearns

[57] ABSTRACT

An educational toy for teaching children the alphabet has a circular or oval base with a plurality of upstanding support rods. Four horizontal mounting rods are supported by the upstanding support rods. The ends of the horizontal mounting rods are each provided with a safety ball tip. A canvas pouch is suspended from the horizontal mounting rods. The canvas pouch is completely closed except for a reach-in top slit opening. A plurality of chips are imprinted on one side with a letter of the alphabet and on the opposite side with the picture of an item having a name beginning with that letter. Another form of chip is printed on one side with a numeral and on the other side by a number of dots corresponding to that numeral. In use, childern remove or insert the chips into the pouch, naming the letter or numeral on each chip.

5 Claims, 5 Drawing Sheets

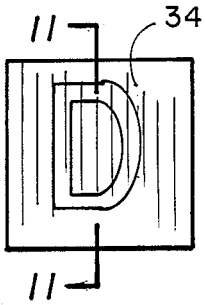
FIG. 10
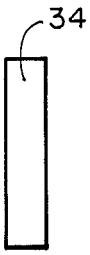
FIG. 11
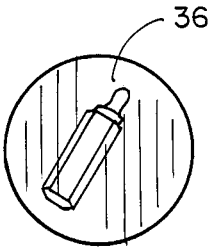
FIG. 13
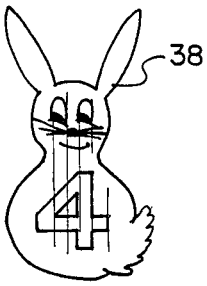
FIG. 15
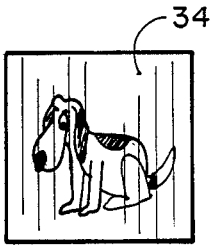
FIG.
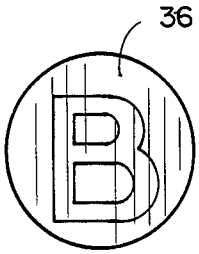
FIG.
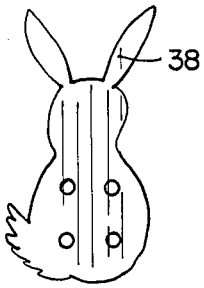
FIG.
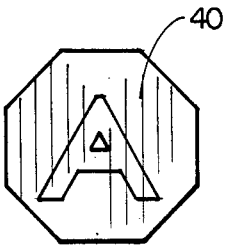
FIG. 17
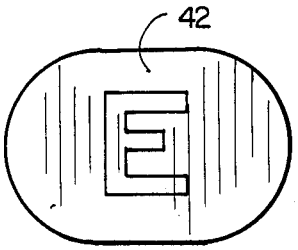
FIG. 19
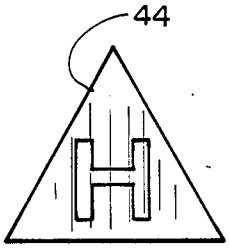
FIG. 21
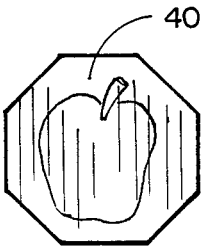
FIG. 18
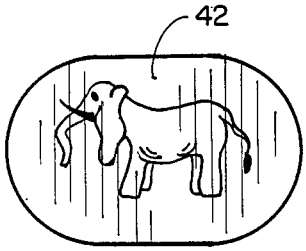
FIG. 20
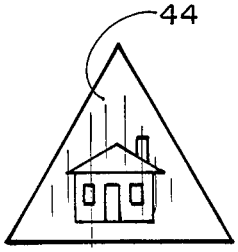
FIG. 22

EDUCATIONAL TOY

BACKGROUND OF THE INVENTION

1. Field of the Invention

The present invention relates to educational toys, and more particularly pertains to a new and improved educational toy for teaching children the alphabet and the number system. Various conventional devices including blocks and demonstration boards have been utilized to attempt to teach children their letters and numbers. However, these conventional devices do not provide an adequate interactive forum for the participation of the child, which is vital to achieve the desired educational objectives. Studies have shown that young children learn more rapidly when allowed to participate in an educational activity. These studies show that associated learning techniques which utilize visual images are most effective in teaching young children. In order to apply these educational theories, the present invention provides an educational toy which utilizes visual images to teach children their letters and numbers and also provides an interactive form for the participation of the children.

2. Description of the Prior Art

Various types of educational toys are known in the prior art. A typical example of such an educational toy is to be found in U.S. Pat. No. 2,412,759, which issued to D. Sullivan on Dec. 17, 1946. This patent discloses a board having a plurality of designated locations for the placement of lettered and numbered circular chips. U.S. Pat. No. 3,768,179, which issued to C. Woodford et al on Oct. 30, 1973, discloses an educational device for teaching alpha-numeric associations which includes a display board having a plurality of alpha-numeric indicia which are provided with electrical contacts which are actuated by the correct placement of the proper letter or number chip in the correct location on the display board. This completes an electrical circuit which activates an audible signal corresponding to each of the alpha-numeric indicia. U.S. Pat. No. 3,811,206, which issued to R. Gaccetta on May 21, 1974, discloses an educational game which utilizes a display board with a plurality of raised numbers. Individual blocks have one side imprinted with a letter of the alphabet and an opposite side provided with a number shaped recessed corresponding to the number of the letter in the alphabet. By arranging the blocks in proper registry with the raised numbers on the display board, a proper sequence of the letters in the alphabet may be achieved. U.S. Pat. No. 3,853,321, which issued to B. Claffie on Dec. 10, 1974, discloses a game to facilitate the learning of the alphabet which includes a game board having a plurality of cut-outs corresponding in configuration to letters of the alphabet. A plurality of metallic letter chips are utilized which are designed to be inserted within the cut-outs of the game board. A magnetic pick-up device is utilized for inserting and removing the metallic letters into the game board recesses. U.S. Pat. No. 4,306,868, which issued to C. Hankins on Dec. 22, 1981, discloses an educational device which utilizes a display board provided with recesses for receiving blocks imprinted with the letters of the alphabet.

While the above mentioned devices are suited for their intended usage, none of these devices provide a stand having a circular oval base with a plurality of upstanding support rods which mount horizontal mounting rods which support a canvas pouch. Additionally, none of the aforesaid educational game devices utilize a plurality of chips imprinted on one side with the letters of the alphabet and on an opposite side with a representation of an item, the name of which begins with the imprinted letter of the alphabet. An additional feature of the present invention not contemplated by the prior art educational devices is the provision of a pouch having a reach-in opening for the reception of chips imprinted on one side with a letter of the alphabet and on an opposite side with an item having a name beginning with that letter. Inasmuch as the art is relatively crowded with respect to these various types of educational toys, it can be appreciated that there is a continuing need for and interest in improvements to such educational toys, and in this respect, the present invention addresses this need and interest.

SUMMARY OF THE INVENTION

In view of the foregoing disadvantages inherent in the known types of educational toys now present in the prior art, the present invention provides an improved educational toy. As such, the general purpose of the present invention, which will be described subsequently in greater detail, is to provide a new and improved educational toy which has all the advantages of the prior art educational toys and none of the disadvantages.

To attain this, representative embodiments of the concepts of the present invention are illustrated in the drawings and make use of an oval or circular base ring having a plurality of upstanding support rods which mount four crossed horizontal mounting rods. A canvas pouch having a reach-in top slit opening is suspended by the horizontal mounting rods. A plurality of chips are utilized, each chip being imprinted with one of the letters of the alphabet on one side and an item having a name beginning with that letter on an opposite side. An additional feature contemplated by the present invention is the provision of slidable scoring rings around each of the horizontal supporting rods. In this fashion, the children may keep score of the number of correct attempts at identifying each lettered chip.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved educational toy which has all the advantages of the prior art educational toys and none of the disadvantages.

It is another object of the present invention to provide a new and improved educational toy which may be easily and efficiently manufactured and marketed.

It is a further object of the present invention to provide a new and improved educational toy which is of a durable and reliable construction.

An even further object of the present invention is to provide a new and improved educational toy which is susceptible of a low cost of manufacture with regard to both materials and labor, and which accordingly is then susceptible of low prices of sale to the consuming public, thereby making such educational toys economically available to the buying public.

Still yet another object of the present invention is to provide a new and improved educational toy which provides in the apparatuses and methods of the prior art some of the advantages thereof, while simultaneously overcoming some of the disadvantages normally associated therewith.

Still another object of the present invention is to provide a new and improved educational toy which utilizes visual association to teach children the letters of the alphabet and the number system.

Yet another object of the present invention is to provide a new and improved educational toy which utilizes a plurality of chips imprinted on one side with a letter of the alphabet and on the opposite side with an item having a name beginning with that letter.

Even still another object of the present invention is to provide a new and improved educational toy which utilizes a circular or oval base ring with a plurality of upstanding support rods and a plurality of horizontally extending mounting rods for suspending a canvas pouch with a reach-in top slit opening.

These together with other objects of the invention, along with the various features of novelty which characterize the invention, are pointed out with particularity in the claims annexed to an forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 10 is a front view of a lettered chip.

FIG. 11 is a cross sectional view taken along line 11—11 of FIG. 10, illustrating a lettered chip.

FIG. 12 is a view of the opposite side of the lettered chip of FIG. 10.

FIG. 13 is a view of one side of another lettered chip.

FIG. 14 is a view of the opposite side of the lettered chip of FIG. 13.

FIG. 15 is a view of a numbered bunny chip.

FIG. 16 is a view of the opposite side of the numbered bunny chip of FIG. 15.

FIG. 17 is a view of another shape of lettered chip.

FIG. 18 is a view of the opposite side of the lettered chip of FIG. 17.

FIG. 19 is a view of still another shape of lettered chip.

FIG. 20 is a view of the opposite side of the lettered chip of FIG. 19.

FIG. 21 is a view of another form of lettered chip.

FIG. 22 is a view of the opposite side of the lettered chip of FIG. 21.

DESCRIPTION OF THE PREFERRED EMBODIMENT

Figure 1:
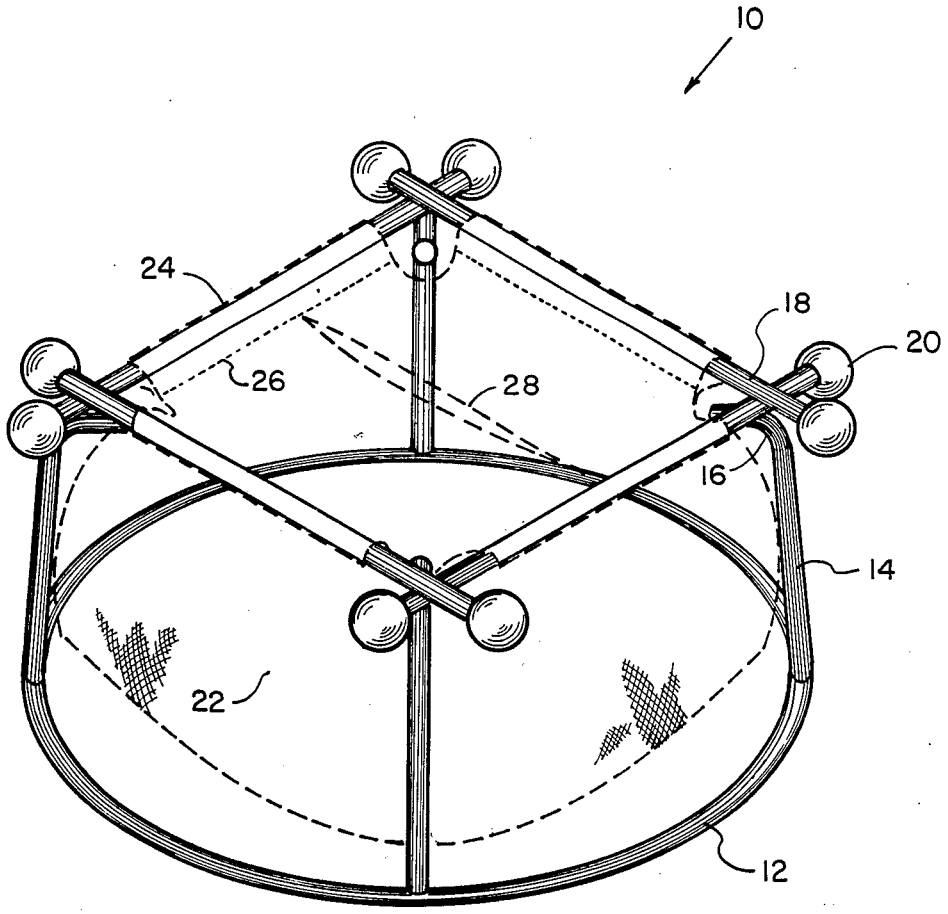
FIG. 1 is a perspective view of the support stand and canvas pouch of the educational toy of the present invention.

With reference now to the drawings, and in particular to FIG. 1 thereof, a new and improved educational toy embodying the principles and concepts of the present invention and generally designated by the reference numeral 10 will be described.

More specifically, it will be noted that the first embodiment 10 of the invention includes an oval shaped base ring 12. This ring may be formed oval or circular in shpae. A plurality of generally vertically extending support rods 14 are circumferentially spaced about the base ring 12. The upper ends of the support rods 14 are preferably slightly inclined toward the center of the base ring 12. The support rods 14 may be molded integrally with or attached to the base ring 12. The upper end of each of the vertical support rods 14 is curved inwardly at 16 and is secured to a pair of intersecting horizontal mounting rods 18. The ends of two of the mounting rods 18 cross above the inwardly curved end 16 of one of the vertical support rods 14. A mounting pin extends from the support rod end 16 through each of the mounting rods 18 and may be secured thereto adhesively or by heat welding. Each of the horizontal mounting rods 18 is provided with a ball shaped safety tip 20. The ball shaped safety tip 20 may be integrally formed with the mounting rod 18 or may be secured adhesively or by heat welding. The base ring 12, vertical supports 14 and horizontal supports 18 are formed from a molded plastic material. A canvas pouch 22 is provided with a plurality of loops 24 which are stitched at 26 for the retention of the horizontal mounting rods 18, in the manner illustrated. The pouch 22 is closed, except for a top reach in slit opening 28. The support stand may be formed in a variety of bright colors and the pouch 22 may likewise be imprinted with a variety of colors and patterns.

Figure 2:
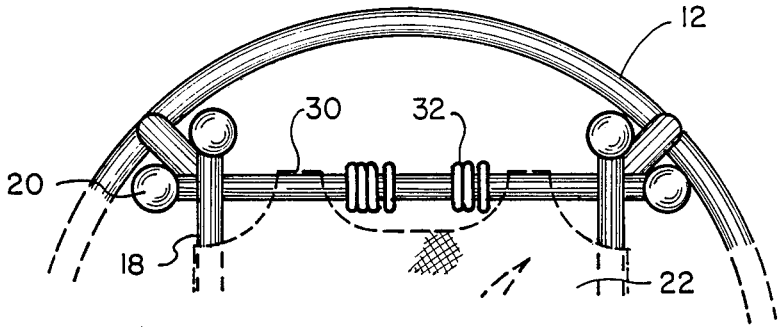
FIG. 2 is a partial top plan view of a modified pouch mounting arrangement which provides slidable score counters.

With reference now to FIG. 2, a modified form of mounting the pouch 22 on the mounting rods 18 is illustrated. In this form, a pair of spaced loops 30 are provided in place of the single elongated loop 24 of FIG. 1. A plurality of individual slidable circular rings 32 are received around each of the tubular horizontal mounting rods 18.

Figure 3:
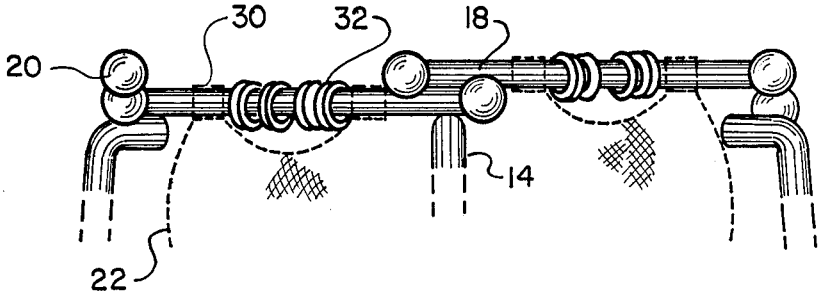
FIG. 3 is a side view of the slidable counter arrangement.

As shown in FIG. 3, the slidable rings 32 are received between a pair of pouch mounting loops 30.

Figure 4:
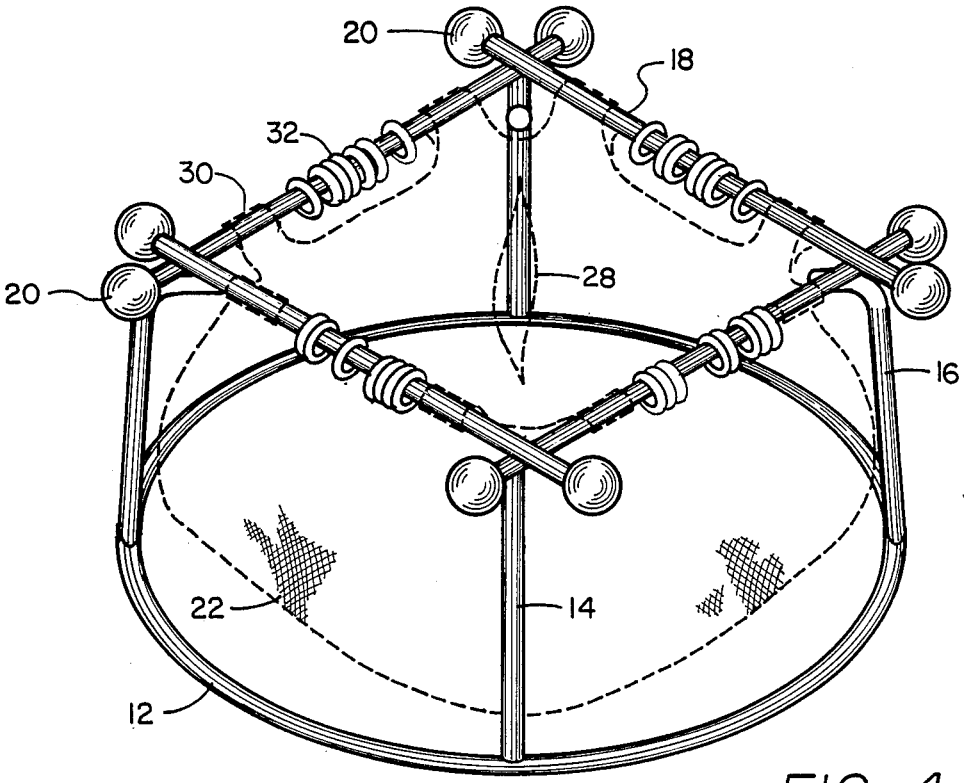
FIG. 4 is a perspective view of the modified form of the support stand and canvas pouch mounting arrangement, illustrating the slidable score counters.

With reference now to FIG. 4, it may be seen that the slidable rings 32 are arranged in four groups, one on each of the horizontal mounting rods 18.

Figure 5:
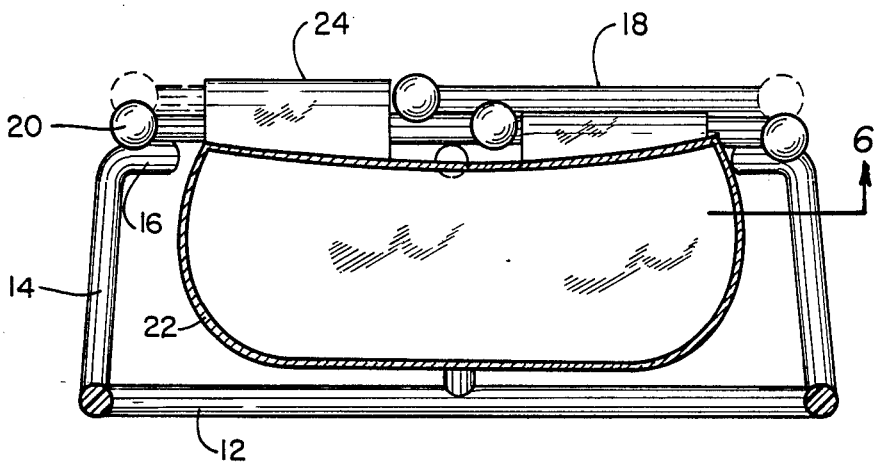
FIG. 5 is a cross sectional view illustrating the support stands and canvas pouch mounting arrangement.

In FIG. 5, a cross sectional view is provided which illustrates the relative extent of the pouch 22 within the mounting ring 12.

Figure 6:
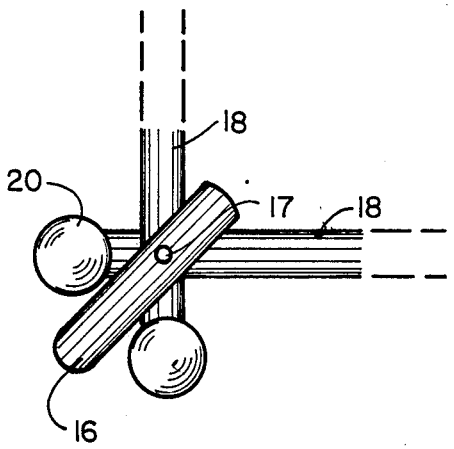
FIG. 6 is a partial detail view illustrating the connection between the vertical support rods and the horizontal pouch mounting rods.

In FIG. 6, it may be seen that the curved end 16 of the vertical support rod 14 is secured to a pair of crossed horizontal mounting rods 18 by virtue of a pin 17. The pin 17, in conjunction with an adhesive or heat weld bonding provides a permanent securement of the rods.

Figure 7:
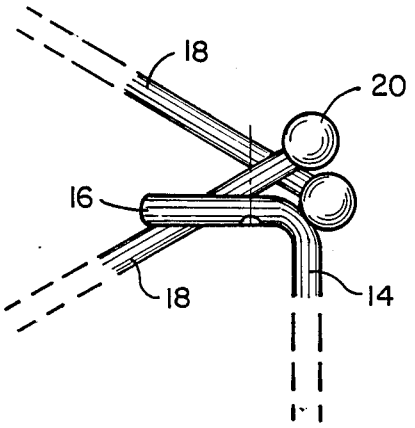
FIG. 7 is another detail view illustrating the connection between the vertical support rods and the horizontal mounting rods.

In FIG. 7, another detail view further illustrates the relative assembly configuration of the vertical support rod 14 with a pair of horizontal mounting rods 18.

Figure 8:
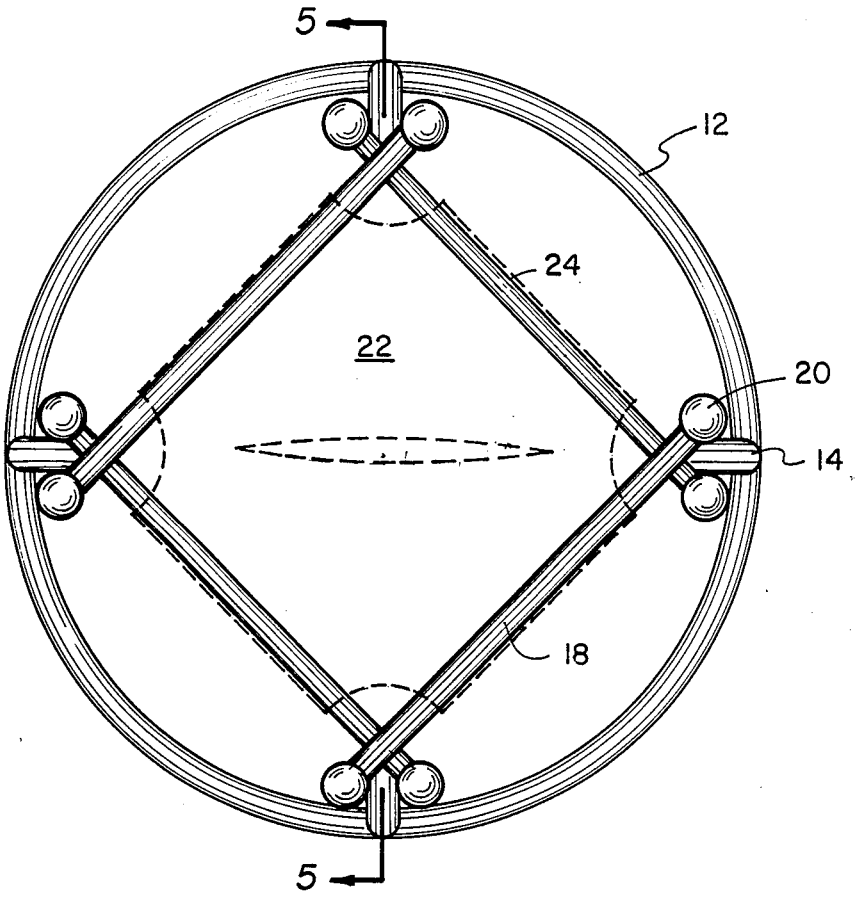
FIG. 8 is a top view of the support stand and canvas pouch.

In FIG. 8, a top plan view of the first form of pouch mounting arrangement, as illustrated in FIG. 1 is provided. The horizontal reach-in slit opening 28 extends across a top surface of the canvas pouch. The pouch 22 is supported within a cage formed by the base ring 12, the vertical support rods 14 and the horizontal mounting rods 18. This provides a stable support stand for the pouch 22 which is resistent to tipping.

Figure 9:
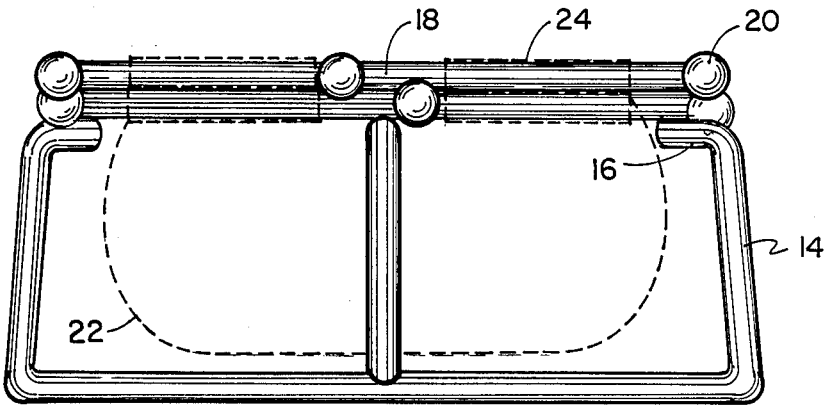
FIG. 9 is a side view of the support stand and canvas pouch.

In FIG. 9, a side view of the mounting stand and canvas pouch 22 is provided.

With reference now to FIG. 10, a first square shape of lettered chip 34 is illustrated. The lettered chip may be imprinted with any of the letters of the alphabet, for example the letter D.

In FIG. 11, a cross sectional view taken along line 11—11 of FIG. 10 is provided, illustrating the relative thickness of the chip 34. Each of the lettered chips contemplated for use in the present invention has a length of approximately three inches and is constructed from a hard plastic material. This makes the chip sufficiently large so as to not be swallowed by small children.

With reference now to FIG. 12, it may be seen that a representation of a dog is imprinted on an opposite side of the square chip 34. Thus, a child may use visual association to correlate the letter D with the first letter in the word DOG.

In FIG. 13, a circular chip 36 may be imprinted with a bottle, as illustrated.

As shown in FIG. 14, an opposite side of the circular chip 36 will be imprinted with the letter B, corresponding to the first letter in the word BOTTLE.

In FIG. 15, a bunny shaped numbered chip 38 has a first side imprinted with the symbol for the number 4.

In FIG. 16, it may be seen that an opposite side of the bunny chip 38 may be imprinted with a number of dots corresponding to the number on the opposite side of the bunny shaped chip 38.

In FIG. 17, an alternative form of lettered chip 40 is illustrated, having a first side imprinted with the letter A.

In FIG. 18, it may be seen that the opposite side of the chip 40 is imprinted with a representation of an APPLE.

In FIG. 19, an additional form of lettered chip 42 has a first side imprinted with the letter E.

In FIG. 20, it may be seen that the opposite side of the lettered chip 42 is imprinted with a representation of an ELEPHANT.

In FIG. 21, a triangular lettered chip 42 has a first side imprinted with the letter H.

In FIG. 22, a view of the opposite side of the triangular lettered chip 44 is provided, illustrating the imprinted HOUSE.

In the use of the educational toy of the present invention, it is contemplated that the child will insert the various lettered and numbered chips into the pouch in their correct order. The lettered and numbered chips are then withdrawn randomly through the top slit opening 28 in the pouch 22. The child then attempts to name the letter or number on the chip. If the child correctly names the letter or number on the chip, the correct answer may be scored by moving one of the slidable score rings 32 (FIG. 4). In this fashion, a number of children may compete in a scored educational exercise.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved educational toy, comprising:

an oval tubular base ring;

four tubular upstanding support rods circumferentially spaced around said base ring;

each of said support rods having one end connected to said base ring and an opposite end curved inwardly toward a center of said base ring;

said support rods inclined upwardly inwardly toward a center of said base ring;

four generally horizontal tubular mounting rods intersecting to form a generally rectangular central opening;

ends of adjacent mounting rods being in overlying relation at each corner of said rectangular central opening;

means securing said overlying mounting rod ends to said curved support rod ends;

a closed canvas pouch suspended from said mounting rods;

said pouch having stitched tubular loop means received around said mounting rods;

a spherical ball secured to each end of said mounting rods; and said pouch having a slit opening in a top surface thereof.

2. The educational toy of claim 1, wherein said tubular loop means comprise two spaced loops received around each of said mounting rods and a plurality of slidable score rings are received around each of said mounting rods between each pair of spaced loops.

3. The educational toy of claim 1, further comprising a plurality of numbered and lettered chips means removably received in said pouch.

4. The educational toy of claim 3, wherein at least one of said plurality of chip means comprises a chip having a letter of the alphabet imprinted on one side and a figure having a name beginning with the letter on the opposite side.

5. The educational toy of claim 3, wherein at least one of said chip means is in the shape of a bunny and has a number printed on one side and the same number of dots printed on the other side.

* * * * *